US005562482A

United States Patent [19]

Wright

[11] Patent Number: 5,562,482

[45] Date of Patent: Oct. 8, 1996

[54] COAXIAL CABLE CONNECTOR AND METHOD OF ASSEMBLING

[76] Inventor: John O. Wright, 2710 St. Andrews Way, York, Pa. 17404

[21] Appl. No.: 367,646

[22] Filed: Jan. 3, 1995

[51] Int. Cl.[6] ..... H01R 4/24

[52] U.S. Cl. ..... 439/429; 439/394; 439/578; 439/805

[58] Field of Search ..... 439/394, 428–9, 439/578, 675, 805

[56] References Cited

U.S. PATENT DOCUMENTS

| | | | |
|---|---|---|---|
| 3,071,751 | 1/1963 | Horndasch | 439/429 |
| 3,109,691 | 11/1963 | Burkhardt | 439/429 |
| 3,199,061 | 1/1965 | Johnson et al. | 439/429 |
| 3,828,298 | 8/1974 | Schumacher | 439/394 |
| 4,583,811 | 4/1986 | McMills | 439/584 |
| 4,655,159 | 4/1987 | McMills | 439/584 |
| 4,795,370 | 1/1989 | Freitag | 439/584 |
| 5,021,010 | 6/1991 | Wright | 439/578 |
| 5,061,207 | 10/1991 | Wright | 439/578 |
| 5,063,659 | 11/1991 | Wright | 29/860 |
| 5,137,470 | 8/1992 | Doles | 439/578 |
| 5,389,012 | 2/1995 | Huang | 439/578 |
| 5,487,679 | 1/1996 | Quantance | 439/428 |

FOREIGN PATENT DOCUMENTS

| | | | |
|---|---|---|---|
| 5-242931 | 9/1993 | Japan | 439/578 |

*Primary Examiner*—Gary F. Paumen
*Assistant Examiner*—Jill DeMello
*Attorney, Agent, or Firm*—William H. McNeill

[57] ABSTRACT

A connector is provided for electrical and mechanical connection to a shielded coaxial cable. The connector includes a metal tubular ferrule having an end segment which is tapered and includes a helical thread-like protuberance which may be screwed into an end of the cable such that the central connector of the cable is sandwiched between the outer surface of the ferrule and the dielectric tube of the cable. A metal cable clamp engages the shield layer of the cable.

21 Claims, 2 Drawing Sheets

COAXIAL CABLE CONNECTOR AND METHOD OF ASSEMBLING

BACKGROUND ART

1. Technical Field

The present invention relates to a connector such as, for example, an audio connector, and method of assembling such a connector to a coaxial cable. The connector may comprise a male or female ferrule which is essentially screwed into an end of the cable to effect a solderless electrical and mechanical connection between the center connector of the cable and the ferrule. A cable clamp serves to provide the required electrical contact with the shield of the cable and to further effect the connection between the central connector and the ferrule.

2. Background Art

Heretofore, the typical connector, such as an audio connector, has been attached to a shielded coaxial cable by soldering the inner or central connector to a male of female ferrule of connector. Examples of such connectors include U.S. Pat. Nos. 5,021,010 and 5,063,659 which name the inventor of the present invention as patentee and GTE Products Corporation as assignee. It is also known to provide a solderless electrical and mechanical connection between a connector and a shielded coaxial cable by means of retaining tabs. Such tabs extend from a ferrule and an example of such a connector includes U.S. Pat. No. 5,061,207 which also names the inventor of the present invention as patentee and GTE Products Corporation as assignee. In this latter patent, tabs are provided which extend from a ferrule and engage a bushing to mechanically connect the ferrule to a connector housing. Electrical contact tabs are also provided which extend from the retaining tabs to electrically and mechanically connect the ferrule to an inner lead such as a signal lead of a cable. In all of such prior art, the cable must be trimmed in such a manner that the central connecter extends from the cable and the shield layer may be folded back against the end of the cable.

DISCLOSURE OF THE INVENTION

It is an object of the present invention to provide a connector for use in effecting a solderless electrical and mechanical connection to a shielded coaxial cable wherein the shield layer of the cable does not need to be folded back upon the cable.

Another object of the present invention is to provide such a connector wherein the stripping of the cable end is simplified.

Yet another object of the present invention is to provide such a connector wherein the central connector of the cable does not need to be trimmed in such a manner as to provide a length of the central connector extending from an end of the cable.

It is a further object of the present invention to provide such a connector wherein there is a gas tight connection at the central connector.

A further object of the present invention is to provide such a connector which may be fabricated having a smaller diameter than that of the prior art.

These objects are accomplished, in one aspect of the invention, by providing a connector for electrical and mechanical connection to a shielded coaxial cable which has an end portion including an outer surface, and a shield layer including an exposed length of a shield layer extending along a longitudinal axis from the end portion to a cable end. The connector comprises a metal cable clamp having a tubular portion which includes a length having an inner surface for engaging the exposed length of the shield layer. A metal tubular ferrule is provided which has a first segment for insertion into the shielded coaxial cable at the cable end along the longitudinal axis and an opposite second segment. The first segment is tapered and includes a first outer surface, and the opposite second segment includes a second outer surface. A plastic tubular bushing is provided which has a bushing inner surface which engages the second outer surface of the opposite second segment of the metal tubular ferrule. A shielded coaxial cable having such a connector mechanically and electrically attached thereto, and a method of joining such a connector to such a cable, is also described herein.

BRIEF DESCRIPTION OF THE DRAWINGS

This invention may be clearly understood by reference to the attached drawings in which.

BEST MODE FOR CARRYING OUT THE INVENTION

Figure 1:
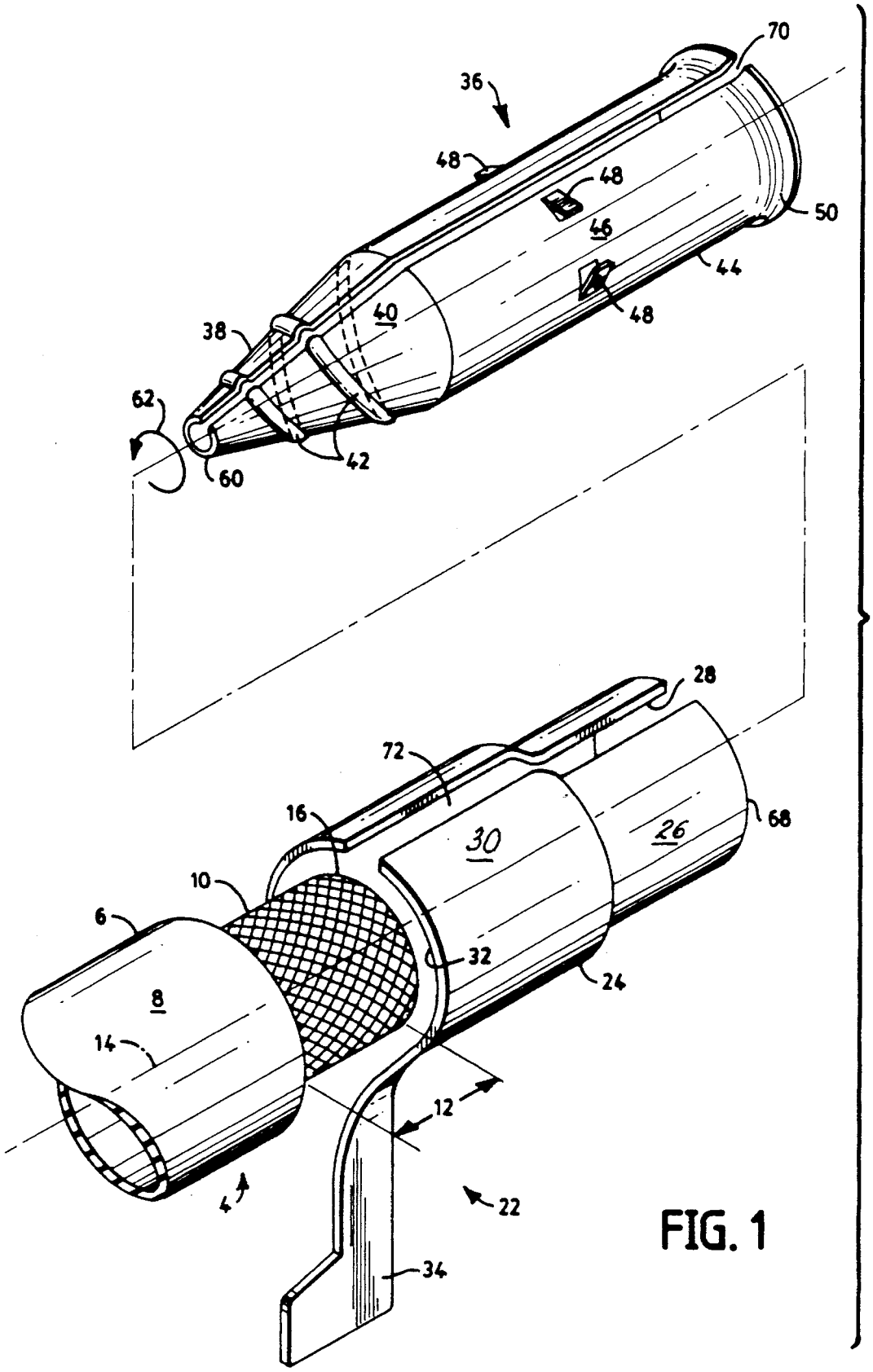
FIG. 1 is an exploded perspective view of the shielded coaxial cable and ferrule attached thereto of the present invention.
Figure 2:
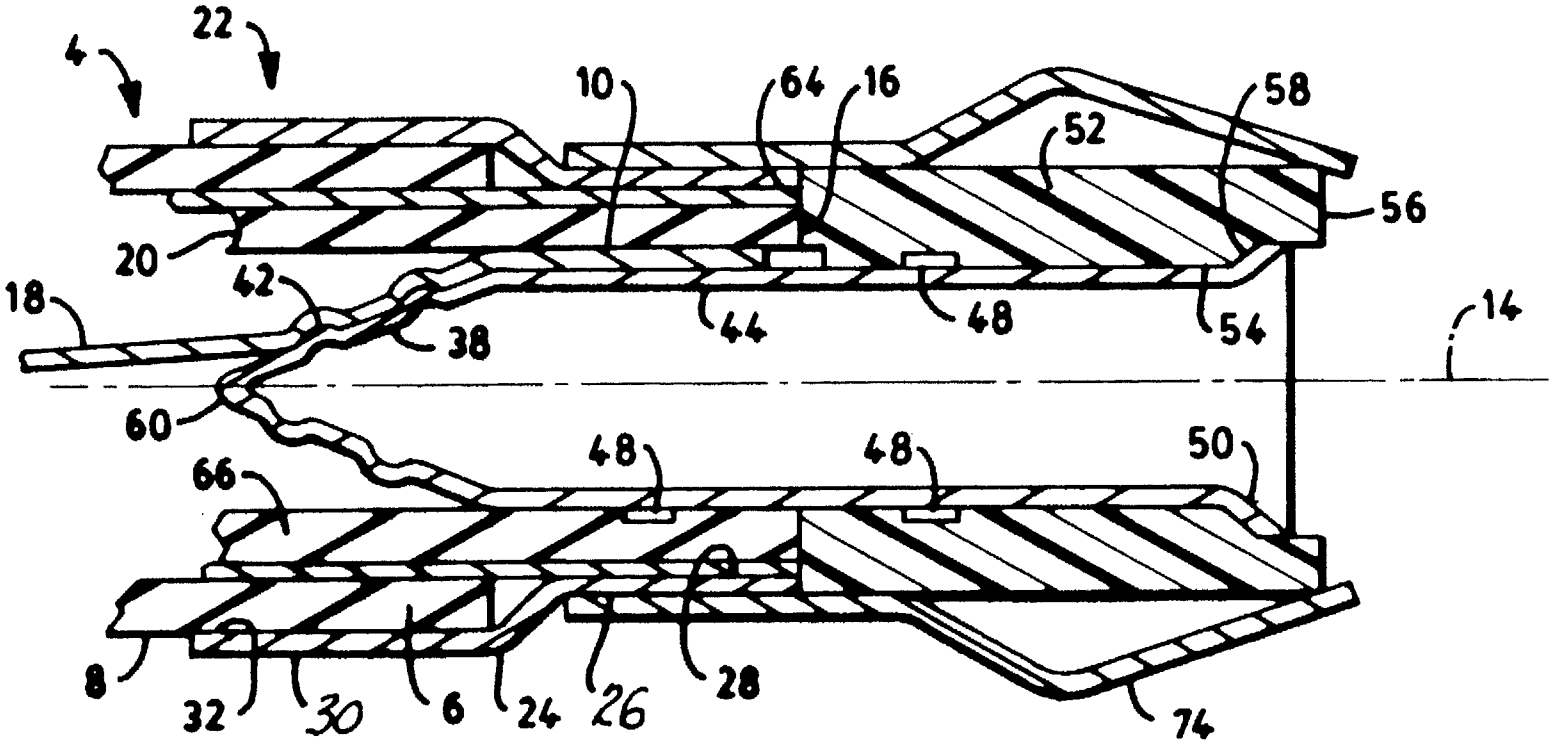
FIG. 2 is a cross sectional view of an embodiment of the present invention which includes the coaxial cable and ferrule of FIG. 1.

The embodiment of this invention which is illustrated in FIGS. 1 and 2 is particularly suited for achieving the objects of this invention. FIGS. 1 and 2 depict a connector for electrical and mechanical connection to a conventional shielded coaxial cable 4 which has an end portion 6 including an outer surface 8 and a shield layer 10. The shield layer 10 has an exposed length 12 which extends along a longitudinal axis 14 from the end portion 6 to a cable end 16. Shielded coaxial cable 4 includes a central conductor 18 which extends within the cable in the direction of longitudinal axis 14. In the preferred embodiment, the shielded coaxial cable 4 includes a concentric dielectric tube 20 which extends in the direction of longitudinal axis 14 between the shield layer 10 and conductor 18.

A metal cable clamp 22 is provided which has a tubular portion 24 including a first length 26. As depicted in FIG. 2, first length 26 includes a first inner surface 28 which engages the exposed length 12 of the shield layer 10. It will be apparent from FIG. 2 that the shield layer 10 does not need to be folded back upon the cable in the conventional manner. Tubular portion 24 of the metal cable clamp 22 also includes a second length 30 having a second inner surface 32. As depicted in FIG. 2, second length 32 engages the outer surface 8 of the shielded coaxial cable 4. The metal cable clamp includes a conventional flange 34 for attaching the cable clamp to a supporting structure as desired.

The metal cable clamp 22 may be fabricated in a conventional manner from a resilient metal such as steel or brass. For example, the clamp 22 may be stamped and formed in the desired configuration. In order to assure satisfactory electrical contact between the clamp and the shield layer 10 as described herein, in the preferred embodiment the inner diameter of the length 30 will be somewhat less than the outer diameter of the cable 4 measured at the exposed length 12. In order to assure satisfactory contact between the clamp and the surface 8 of the cable 4, in the preferred embodiment the inner diameter of the length 26 will be somewhat less than the outer diameter of the cable 4 measured at the surface 8. Assembly of the clamp 22 to the cable 4 will be explained hereinafter.

A metal tubular ferrule 36 is provided having a first segment 38 for insertion as described herein into the shielded coaxial cable 4 at the cable end 16 along the longitudinal axis 14. Although FIGS. 1 and 2 depict a female ferrule for connection to a male connector it will be apparent to those skilled in the art that ferrule 36 may be a male ferrule for connection to a female connector. The first segment 38 is tapered and includes a first outer surface 40 which in the preferred embodiment includes a helical 20 thread-like protuberance 42. Ferrule 36 also has an opposite second segment 44 which includes a second outer surface 46. The metal tubular ferrule 36 preferably includes at least one tab 48 which extends radially away from a longitudinal axis of the ferrule which in the drawings is coextensive with axis 14. In the preferred embodiment there is a plurality of tabs 48. Tabs 48 may provide longitudinal and anti-rotational retention of the ferrule 36 relative to the cable 4 as described hereinafter. In the embodiment of FIGS. 1 and 2, the second segment 44 of the metal tubular ferrule 36 includes a fluted end portion 50.

A plastic tubular bushing 52 is provided. Bushing 52 includes an inner surface 54 and is attached to ferrule 36 as described herein.

The metal tubular ferrule 36 may be fabricated in a conventional manner from a resilient metal such as brass. For example, the ferrule 36 may be stamped to provide the protuberance(s) 42 and then formed to the desired configuration. In order to assure satisfactory contact between the ferrule 36 and bushing 52 as described herein, in the preferred embodiment the outer diameter of the ferrule at outer surface 46 will be somewhat greater than the inner diameter of the bushing 52 at inner surface 54.

In assembling the connector of the present invention with the shielded coaxial cable 4, an end of the cable is stripped so that the end of the central conductor 18 is substantially adjacent to cable end 16 and the length 12 of the shield layer 10 is exposed. The plastic tubular bushing 52 is attached to the second segment 44 of the metal tubular ferrule 36 by inserting the segment 44 into the bushing as depicted in Fig. 2. To this end, the first segment 38 of the ferrule may be inserted into end 56 of the bushing and pushed through the bore of the bushing until the flutted end 50 is adjacent end 56. Since the ferrule 36 is fabricated from a resilient metal and includes a slit 70 which extends in the direction of the longitudinal axis of the ferrule for the entire length thereof, the ferrule can be forced through the bushing 52 as the ferrule contracts to accommodate to the inner surface 54 of the bushing. If desired, the bushing may include a countersunk portion at end 56 to provide a tapered surface 58 against which the fluted end 50 may be caused to abut as depicted in FIG. 2. The tapered surface also serves to cam the tabs 48 towards the longitudinal axis of the ferrule 36 to facilitate insertion of the ferrule into the bushing 52. When the ferrule 36 has been inserted to the extent desired, as depicted, for example, in FIG. 2, the resiliency of tabs 48 will serve to urge tabs 48 against the inner surface 54 of the bushing 52 to retain the ferrule in place relative to the bushing.

The metal tubular ferrule 36 may now be inserted into the shielded coaxial cable 4 to effect an electrical connection between the ferrule and the central conductor 18 by grasping the plastic tubular bushing 52 and inserting the tapered segment 38 of the ferrule into the cable at cable end 16. In the preferred embodiment, this may be accomplished by inserting the tip 60 of the tapered segment 38 into cable end 16 at a position off center relative to axis 14 so that the central conductor 18 will be in contact with outer surface 40 as the ferrule is inserted into the cable. Insertion is facilitated by turning the ferrule in a screwing motion in the direction of arrow 62 to essentially screw the ferrule into the cable. Insulating thread commonly wrapped around the central conductor 18 will be separated from the central conductor by threads or protuberances 42. In the preferred embodiment, the ferrule 36 is screwed into cable 4 until an end 64 of the bushing 52 abuts cable end 16 as depicted in FIG. 2. The outer diameter of the segment 46 of the ferrule 36 will be such that when the ferrule has been inserted into the cable 4 to the extent desired, the central conductor 18 will be sandwiched between the outer surface 46 of the segment 44 and an inner surface 66 of the dielectric tube 20 to provide a gas tight and solderless connection at the central connector 18. In addition, the outer diameter of the segment 46 of the ferrule 36 will be such that when the ferrule has been inserted into the cable 4 to the extent desired, as depicted in FIG. 2, the resiliency of tabs 48 will serve to urge tab 48 against the inner surface 66 of the dielectric tube 20 to depress inner surface 66 and retain the ferrule in place relative to the cable.

Although soldering is not required, if desired the ferrule 36 may comprise a pre-solder plated material. In such an embodiment, subsequent to assembly of the connector of the present invention with the cable the solder would be reflowed by induction heating or some other known manner thereby providing redundancy at the joint between the central connector 18 of the ferrule 36.

The metal cable clamp may now be attached to the shielded coaxial cable to effect an electrical connection between the shield layer 10 and the cable clamp and to facilitate mechanically holding the conductor 18 in place relative to the ferrule 36. To accomplish this the end of the cable 4 opposite cable end 16 may be inserted into the cable clamp at end 68. Since the cable clamp is fabricated from a resilient metal and includes a longitudinal slit 72 which extends for the entire length of the clamp, the cable 6 can be forced through the clamp as the clamp expands to accommodate the cable, the clamp being slid along the length of the cable until the inner surface 28 of the length 30 of the clamp is in contact with the exposed length 12 of the shield layer 10. In this position, the inner surface 32 of the length 26 will engage outer surface 8 of end portion 6 of the shielded coaxial cable 4. In this manner, the cable clamp will serve to compress the center connector 18 against ferrule 36 to effect a gas tight joint and eliminate the need for solder.

After the female connector has been attached to the cable 4 a male connector may be inserted into the female connector in the usual manner. In order to simplify the drawings only conventional connector shell 74 of a conventional male connector is depicted in FIG. 2.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A connector for electrical and mechanical connection to a shielded coaxial cable which has an end portion including an outer surface, and a shield layer including an exposed length of said shield layer extending in the direction of a longitudinal axis of said shielded coaxial cable from said end portion to a cable end, said connector comprising:

a metal cable clamp having a tubular portion including a first length having a first inner surface for engaging said exposed length of said shield layer;

a metal tubular ferrule having a first segment for insertion into said shielded coaxial cable at said cable end along said longitudinal axis and an opposite second segment, said first segment being tapered and having a first outer surface, and said opposite second segment having a second outer surface; and a plastic tubular bushing having a bushing inner surface which engages said second outer surface of said opposite second segment of said metal tubular ferrule.

2. The connector of claim 1 wherein said tubular portion of said metal cable clamp includes a second length having a second inner surface for engaging said outer surface.

3. The connector of claim 1 wherein said first outer surface includes a helical thread-like protuberance.

4. The connector of claim 1 wherein said metal tubular ferrule comprises a slit which extends in a longitudinal direction of said metal tubular ferrule for the entire length of said metal tubular ferrule.

5. The connector of claim 1 wherein said second outer surface comprises at least one tab extending radially away from a longitudinal axis of said metal tubular ferrule.

6. The connector of claim 1 wherein said second outer surface comprises a plurality of tabs extending away from a longitudinal axis of said metal tubular ferrule.

7. The connector of claim 1 wherein said second segment comprises a fluted end portion.

8. A shielded coaxial cable having a connector mechanically and electrically attached thereto, comprising:

a shielded coaxial cable having an end portion including an outer surface, and a shield layer including an exposed length of said shield layer extending in the direction of a longitudinal axis of said shielded coaxial cable from said end portion to a cable end, and a conductor extending within said shielded coaxial cable along said longitudinal axis;

a metal cable clamp having a tubular portion including a first length having a first inner surface which engages said exposed length of said shield layer;

a metal tubular ferrule having a first segment and an opposite second segment, said first segment being tapered and having a first outer surface, and said opposite second segment having a second outer surface; said first segment being inserted into said shielded coaxial cable at said cable end along said longitudinal axis; said ferrule engaging said conductor; and a plastic tubular bushing having a bushing inner surface which engages said second outer surface of said opposite second segment of said metal tubular ferrule.

9. The shielded coaxial cable of claim 8 wherein said tubular portion of said metal cable clamp includes a second length having a second inner surface which engages said outer surface.

10. The shielded coaxial cable of claim 8 wherein said first outer surface includes a helical thread-like protuberance screwed into said first segment.

11. The connector of claim 8 wherein said metal tubular ferrule comprises a slit which extends in the direction of said longitudinal axis for the entire length of said metal tubular ferrule.

12. The shielded coaxial cable of claim 8 wherein said second outer surface comprises at least one tab which extends away from said longitudinal axis and depresses said bushing inner surface.

13. The shielded coaxial cable of claim 8 wherein said second segment comprises a fluted end portion which is adjacent an end of said plastic tubular bushing.

14. The shielded coaxial cable of claim 8 wherein said shielded coaxial cable further comprises a dielectric tube which extends in the direction of said longitudinal axis between said shield layer and said conductor, said conductor being sandwiched between said ferrule and said dielectric tube.

15. The shielded coaxial cable of claim 14 wherein said second outer surface comprises at least one tab which extends away from said longitudinal axis and depresses a dielectric tube inner surface.

16. A method of joining a connector to a shielded coaxial cable which has an end portion including an outer surface, an inner portion and a shield layer including an exposed length of said shield layer extending in the direction of a longitudinal axis of said shielded coaxial cable from said end portion to a cable end, and a conductor extending within said shielded coaxial cable in the direction of said longitudinal axis, comprising the steps of:

inserting a metal tubular ferrule, having a first segment and an opposite second segment, said first segment being tapered and having a first outer surface, and said second segment having a second outer surface, into said shielded coaxial cable at said cable end along said longitudinal axis causing said ferrule to contact said conductor; and attaching a metal cable clamp, having a tubular portion including a first length having a first inner surface, to said shielded coaxial cable causing said first inner surface to engage said exposed length of said shield layer.

17. The method of claim 16 wherein said first outer surface includes a helical thread-like protuberance, and wherein said inserting step comprises screwing said first segment into said shielded coaxial cable at said cable end along said longitudinal axis.

18. The method of claim 16 wherein said tubular portion further includes a second length having a second inner surface, and wherein said attaching step includes causing said second inner surface to engage said outer surface of said end portion of said shielded coaxial cable.

19. The method of claim 16 comprising the further step of retaining said metal tubular ferrule within said shielded coaxial cable, said second outer surface of said second segment having at least one tab which extends away from said longitudinal axis, by inserting said metal tubular ferrule into said shielded coaxial cable until said at least one tab engages said inner portion.

20. The method of claim 16 comprising the further step of attaching a plastic tubular bushing, having a bushing inner surface, to said second segment of said metal tubular ferrule by inserting said second segment into said plastic tubular bushing.

21. The method of claim 20 comprising the further step of retaining said metal tubular ferrule within said plastic tubular bushing, said second outer surface of said second segment having at least one tab which extends away from said longitudinal axis, by inserting said metal tubular ferrule into said plastic tubular bushing until said at least one tab engages said bushing inner surface.

* * * * *